US011692151B2

(12) United States Patent
Zhang

(10) Patent No.: US 11,692,151 B2
(45) Date of Patent: Jul. 4, 2023

(54) LUBRICATING GREASE OF POLYUREA/HIGH BASE NUMBER CALCIUM SULFONATE COMPOSITE

(71) Applicant: LANXESS CORPORATION, Pittsburgh, PA (US)

(72) Inventor: Lianhui Zhang, Shanghai (CN)

(73) Assignee: LANXESS Corporation, Pittsburgh, PA (US)

( * ) Notice: Subject to any disclaimer, the term of this patent is extended or adjusted under 35 U.S.C. 154(b) by 0 days.

(21) Appl. No.: 17/537,568

(22) Filed: Nov. 30, 2021

(65) Prior Publication Data

US 2022/0081639 A1 Mar. 17, 2022

Related U.S. Application Data

(63) Continuation of application No. 16/603,716, filed as application No. PCT/CN2018/081570 on Apr. 2, 2018, now Pat. No. 11,225,627.

(30) Foreign Application Priority Data

Apr. 19, 2017 (CN) ..... 201710255506.0

(51) Int. Cl.

| | |
|---|---|
| ***C10M 169/00*** | (2006.01) |
| ***C10M 115/10*** | (2006.01) |
| ***C10M 117/04*** | (2006.01) |
| ***C10M 119/24*** | (2006.01) |
| ***C10M 123/04*** | (2006.01) |
| ***C10M 125/10*** | (2006.01) |
| ***C10M 125/26*** | (2006.01) |
| ***C10M 177/00*** | (2006.01) |
| *C10N 50/10* | (2006.01) |

(52) U.S. Cl.

CPC ..... *C10M 169/00* (2013.01); *C10M 115/10* (2013.01); *C10M 117/04* (2013.01); *C10M 119/24* (2013.01); *C10M 123/04* (2013.01); *C10M 125/10* (2013.01); *C10M 125/26* (2013.01); *C10M 177/00* (2013.01); *C10M 2201/062* (2013.01); *C10M 2201/087* (2013.01); *C10M 2203/003* (2013.01); *C10M 2207/1285* (2013.01); *C10M 2217/0456* (2013.01); *C10M 2219/0445* (2013.01); *C10M 2219/0466* (2013.01); *C10N 2050/10* (2013.01)

(58) Field of Classification Search

CPC ..... C10M 169/00; C10M 115/10; C10M 117/04; C10M 119/24; C10M 123/04; C10M 125/10; C10M 125/26; C10M 177/00; C10M 2201/062; C10M 2201/087; C10M 2203/003; C10M 2207/1285; C10M 2217/0456; C10M 2219/0445; C10M 2219/0466; C10M 2207/126; C10M 2207/128; C10M 2215/065; C10M 2215/1026; C10M 2219/044; C10N 2050/10; C10N 2010/04; C10N 2030/06; C10N 2030/12; C10N 2030/45

USPC ..... 508/158

See application file for complete search history.

(56) References Cited

U.S. PATENT DOCUMENTS

| | | | | |
|---|---|---|---|---|
| 5,338,467 A * | 8/1994 | Olson | C10M 121/00 | 508/393 |
| 2003/0176298 A1* | 9/2003 | Nakatani | C10M 169/02 | 508/552 |

* cited by examiner

*Primary Examiner* — Prem C Singh
*Assistant Examiner* — Francis C Campanell
(74) *Attorney, Agent, or Firm* — Nicanor A. Kohncke; Christopher L. McDavid; Ewa M. Wozniak

(57) ABSTRACT

The invention discloses a lubricating grease with thixotropy and a preparation method thereof. The lubricating grease comprises a polyurea/high base number calcium sulfonate composite thickener, colloidally dispersed calcium carbonate solid particles in the form of calcite, a calcium borate or calcium borate composite, and a calcium soap of fatty acid having 12 to 24 carbon atoms. The above components are uniformly dispersed in an oil phase medium. The content of high base number calcium sulfonate in the lubricating grease is less than 22 wt %.

13 Claims, No Drawings

LUBRICATING GREASE OF POLYUREA/HIGH BASE NUMBER CALCIUM SULFONATE COMPOSITE

High performance, thixotropic polyurea/overbased calcium sulfonate complex hybrid greases comprising solid particles of colloidally dispersed calcium carbonate essentially in the form of calcite, calcium soap of a fatty acid of 12 to 24 carbon atoms, calcium borate or calcium borate complex, and oleaginous medium are provided, which have lower concentrations of overbased calcium sulfonate for each thickness grade than available overbased calcium sulfonate complex greases, for example, greases of the invention are provided comprising less than 22 wt % overbased calcium sulfonate complex that have a worked cone penetration rating of 295 or less.

Corrosion-inhibiting, thixotropic greases or grease-like overbased calcium sulfonate compositions are well known, as is their use in a variety of demanding applications. Such greases or grease-like compositions can be used alone, or in combination with other components, and in general exhibit good extreme pressure and antiwear properties, high dropping points, mechanical stability, salt spray and water-corrosion resistance, thermal stability at high temperatures, and other desirable properties.

Greases are rated or graded on the basis of their worked cone penetration range. For the purposes of this invention, cone penetration is measured by the ASTM cone penetration test (D217). Penetration is the depth, in tenths of millimeters, to which a standard cone sinks into the grease under prescribed conditions. Higher penetration numbers indicate softer greases with a higher base oil content, since the cone has sunk deeper into the sample. For example, greases sold under the designation grade zero have a cone penetration number from 355 to 385, those having a cone penetration range of 310 to 340 are designated grade one and the most widely sold greases have a cone penetration range of 265 to 295 and are designated grade two.

U.S. Pat. No. 4,560,489 discloses a calcium borate modified overbased calcium sulfonate complex grease broadly defined as a combination of (1) an overbased calcium sulfonate in an oil, particularly a mineral oil, containing finely divided particles (20 to 5,000A, e.g., 50 to 1000 A) of calcium carbonate in the form of calcite; (2) a product formed by the reaction of boric acid with a calcium compound (e.g., calcium hydroxide or calcium carbonate), presumably calcium borate or calcium borate intermingled or in some kind of complex in the grease or grease composition as a whole; and (3) a product formed from calcium hydroxide/calcium carbonate (as calcite) and a soap-forming aliphatic monocarboxylic or fatty acid, preferably a soap-forming hydroxy-fatty acid, such as 12-hydroxystearic acid. The overall composition of the (1), (2) and (3) products are believed to be present in a complex system not yet fully understood.

The grease of U.S. Pat. No. 4,560,489 can be prepared by a process wherein neutral calcium sulfonate, in a mixture with hydrated lime, lubricating oil, a converting agent capable of converting amorphous calcium carbonate into crystalline calcium carbonate, a catalyst (such as methanol) suitable for promoting conversion of the neutral calcium sulfonate is carbonated to form a non-Newtonian overbased calcium sulfonate system, after which additional oil base stock, lime, water, boric acid and calcium-soap-forming aliphatic fatty acid, preferably a hydroxy fatty acid, are added, reacted at elevated temperatures and optionally further processed to complete the production of the overbased calcium sulfonate grease. Likewise, a Newtonian overbased calcium sulfonate may be used instead of the neutral calcium sulfonate above, is first converted to a thickened intermediate non-Newtonian product by initial treatment at elevated temperatures with a converting agent such as acetic acid, propionic acid or an alcohol, after which, at elevated temperatures, boric acid, water, lime or calcium hydroxide, and calcium-soap-forming aliphatic fatty acid (preferably a hydroxy fatty acid) are added. In either process, the calcium-soap-forming aliphatic fatty acid added typically contains 12 to 24 carbon atoms and is added to the non-Newtonian overbased calcium sulfonate wherein the calcium carbonate is in the calcite form.

The greases of U.S. Pat. No. 4,560,489 have excellent properties; however, to obtain a worked cone penetration of 265 to 295, the grease must contain about 40 to 45% by weight overbased calcium sulfonate. If the content of overbased calcium sulfonate is 38% by weight or less, a relatively soft, generally undesired grease is obtained.

Research focuses on reducing ash content and cost in preparing these greases, thus there is great interest in research in reducing the overbased calcium sulfonate content without lowering the grease grade.

U.S. Pat. No. 5,308,514 discloses high performance overbased calcium sulfonate complex greases comprising overbased calcium sulfonate, solid particles of colloidally dispersed calcium carbonate in the form of calcite, calcium borate, and a calcium soap of a fatty acid of 12 to 24 carbon atoms, dispersed in an oleaginous medium, similar to the grease components of U.S. Pat. No. 4,560,489, but having lower concentrations of overbased calcium sulfonate for each grade of the grease than the grease of U.S. Pat. No. 4,560,489.

The grease of U.S. Pat. No. 5,308,514 is formed using processes similar to those of U.S. Pat. No. 4,560,489, except that at least a portion of the $C_{12-24}$ calcium-soap forming acid is present in the reaction mixture during calcite formation. For example, a mixture of overbased calcium sulfonate comprising amorphous calcium carbonate, and a converting agent comprising a fatty acid (preferably a hydroxy fatty acid) of 12 to 24 carbon atoms capable of forming a calcium soap in an oleaginous medium is heated to convert the amorphous calcium carbonate to calcite, and then after calcite formation, additional fatty acid of 12 to 24 carbon atoms capable of forming a calcium soap, and an inorganic acid (such as a boron acid, or organic acid of 1 to 7 carbon atoms) are added thereto, and the resulting mixture is heated to form calcium salts and calcium soaps of fatty acid in situ. As above, best results are obtained when boric acid is used in the step following calcite formation.

The fatty acid of 12 to 24 carbon atoms that is added before calcite formation and after calcite formation typically comprises the same fatty acid, and the inorganic acid, e.g., boric acid, may also be present in the reaction mixture prior to calcite formation. Additional lime or calcium hydroxide may also be added but is not always necessary.

U.S. Pat. No. 5,308,514 also discloses that a process wherein excess lime is added along with the fatty acid of 12 to 24 carbon atoms during the calcite conversion step also yields an overbased calcium sulfonate complex grease with a lower concentration of overbased calcium sulfonate for each grade than the grease of U.S. Pat. No. 4,560,489. However, this process is not preferred because the grease produced by this process has poor pumping properties and typically contains less base oil than the grease from the process in the preceding paragraph.

It is further disclosed in U.S. Pat. No. 5,308,514 that if all of the fatty acid of 12 to 24 carbon atoms capable of forming a calcium soap is employed in the conversion step without excess lime but employing pressure, grade 2 greases can be produced containing about 32% by weight of starting overbased calcium sulfonate but vaterite calcium carbonate crystals are formed with the calcite calcium sulfonate. Vaterite crystals should be avoided because while the calcite crystal form produces non-Newtonian rheology, enhances yield and improves high temperature properties of the grease, the vaterite form does not improve high temperature properties of the grease.

Even though U.S. Pat. No. 5,308,514 provides greases with a relatively low concentration of overbased calcium sulfonate, it still requires having from 23 to 28% by weight of overbased calcium sulfonate to obtain a grease having a worked cone penetration rating of 265 to 295. Greases with lower concentrations of overbased calcium sulfonate at each rating are desired. Polyurea greases are known that have a much lower ash content and good all-around performance characteristics, however, polyurea greases tend to show poor mechanical stability.

U.S. Pat. No. 6,037,314 discloses a polyurea grease composition for constant velocity joints comprising (a) a base oil and (b) a urea thickener, and certain additives needed to improve performance, i.e., (c) at least one organic molybdenum compound, (d) at least one calcium salt selected from the group consisting of calcium salts of petroleum sulfonates, calcium salts of alkyl aryl sulfonates, calcium salts of salicylate, calcium salts of phenates, calcium salts of oxidized waxes, overbasic calcium salts of petroleum sulfonates, overbasic calcium salts of alkyl aryl sulfonates, overbasic calcium salts of salicylate, overbasic calcium salts of phenates, and overbasic calcium salts of oxidized waxes; and (e) a thiophosphate.

U.S. Pat. No. 4,902,435 discloses greases with a hybrid thickener system, which uses both polyurea and calcium soap thickeners, and an additive package containing tricalcium phosphate and calcium carbonate to improve performance. The calcium soap thickeners used therein are simple calcium soaps or calcium complex soaps, but these are not the calcium sulfonate complex soaps of U.S. Pat. Nos. 5,308,514 and 4,560,489 that are prepared from overbased calcium sulfonate wherein the amorphous calcium carbonate is converted into calcite form. Overbased calcium sulfonate is mentioned in U.S. Pat. No. 4,902,435 as a possible source of the calcium carbonate portion of the additive package. Similar greases are disclosed in U.S. Pat. No. 5,084,193.

Overbased calcium sulfate complex greases have excellent properties, but the ash content due to the amount of calcium sulfonate, calcium soaps and other materials required is too high for many applications. Polyurea greases having a much lower ash content and many good performance characteristics are known, but tend to show poor mechanical stability.

SUMMARY OF THE INVENTION

It has been found that by replacing a portion of the overbased calcium sulfonate in overbased calcium sulfonate complex greases with a polyurea thickener, thixotropic high performance polyurea/overbased calcium sulfonate complex greases can be formed, which greases have all the excellent performance and pumping characteristics of the overbased calcium sulfonate complex greases of U.S. Pat. No. 5,308,514 while having a significantly reduced ash content, and vastly improved mechanical stability when compared with polyurea greases.

The high performance, thixotropic polyurea/overbased calcium sulfonate complex hybrid greases of the invention comprise, in addition to the polyurea/overbased calcium sulfonate complex thickener, solid, finely divided particles of colloidally dispersed calcium carbonate in the form of calcite, calcium borate or complex of calcium borate, and a calcium soap of a fatty acid of 12 to 24 carbon atoms, preferably a soap of a hydroxy fatty acid, evenly dispersed in an oleaginous medium, e.g., one or more non-volatile oils, such as a mineral oil or other lubricating oil, wherein the greases contain less than 22% by weight, typically 20% by weight or less, of overbased calcium sulfonate. In preferred embodiments, the grease has a worked cone penetration rating of 295 or less. The present greases also contain less borate salts and calcium soaps than overbased calcium sulfonate complex hybrid greases in the art, due to replacing a portion of the overbased calcium sulfonate with the polyurea thickener, thus further lowering the ash content.

For example, in one preferred embodiment the invention provides a grade 2 grease, i.e., a grease having a worked cone penetration rating 265-295, comprising less than 21 wt % overbased calcium sulfonate and at least 70% by weight oil, and typically at least 75% or 80% by weight, of a non-volatile oil.

The greases of the invention are made using variations of known methods. For example, one process comprises a step wherein a mixture of overbased calcium sulfonate comprising amorphous calcium carbonate, water, a converting agent at least a portion of which comprises a fatty acid, preferably a hydroxy fatty acid, of 12 to 24 carbon atoms capable of forming a calcium soap, alkylbenzene sulfonic acid and boric acid in an oleaginous medium is heated to convert the amorphous calcium carbonate to calcite in a manner similar to that of U.S. Pat. No. 5,308,514; a further step wherein a poly isocyanate and one or more amine containing compounds is added to form a polyurea in a manner similar to that of U.S. Pat. No. 4,902,435, followed by processing to prepare a grease of the desired rating. Other alternative processes are also discussed below.

DESCRIPTION OF THE INVENTION

The high performance, thixotropic, polyurea/overbased calcium sulfonate complex hybrid greases of the invention comprise:

70 wt % or more, e.g., 70 to 90 wt % or 70 to 85 wt %, oleaginous medium in which there is homogeneously dispersed:

less than 22 wt %, e.g., 8 to 21 wt %, overbased calcium sulfonate complex thickener comprising fine particles of calcium carbonate in calcite form;

0.5 to 6.5 wt % polyurea thickener;

0.05 to 3 wt %, calcium borate or a calcium borate complex;

0.05 to 5 wt %, e.g., 0.5 to 3.5 wt %, calcium soaps of $C_{12-24}$ aliphatic fatty acids; and 0 to 3 wt % lime or calcium hydroxide from lime or calcium hydroxide not consumed in the reactions during preparation of the grease;

wherein all percentages are weight % based on the total weight of the grease.

In many embodiments, the grease of the invention comprises:

75 to 85 wt %, or 80 to 85 wt %, oleaginous medium;

less than 21 wt %, e.g., 8 to 20 wt % or 10 to 19 wt %, overbased calcium sulfonate complex thickener comprising fine particles of calcium carbonate in calcite form;

0.8 to 4.8 or 5 wt % polyurea thickener;

0.1 to 3 wt % calcium borate or a calcium borate complex;

0.8 to 3.5 wt % calcium soap of $C_{12-24}$ aliphatic fatty acids; and 0 to 3 wt % lime or calcium hydroxide from lime or calcium hydroxide not consumed in the reactions during preparation of the grease.

At least a portion of the calcium soap of $C_{12-24}$ aliphatic fatty acids is formed in situ during conversion of the calcium carbonate to calcite, and preferably all of the calcium soap of $C_{12-24}$ aliphatic fatty acids are formed in situ during the processing of the overbased calcium sulfonate during preparation of the grease. More than one type of calcium soap may be present, i.e., calcium soaps of different fatty acids may be present. Preferably the calcium soaps of $C_{12-24}$ aliphatic fatty acids comprise calcium soaps of hydroxy $C_{12}$-$C_{24}$ fatty acids, in particular 12-hydroxystearic acid. It is also more preferred that the calcium borate species is formed in situ during the processing of the overbased calcium sulfonate during preparation of the grease. In some embodiments, the grease may also comprise calcium salts of short chain organic acids having from one to seven carbon atoms.

Various common supplemental ingredients, e.g., antioxidants phenyl alpha naphthylamine and other additives, are often incorporated into the greases of the invention at commonly used levels.

The grease is prepared according to a general process wherein 1) an overbased calcium sulfonate comprising amorphous calcium carbonate starting material in an oleaginous medium, e.g., base oil, is heated in the presence of water, a conversion agent comprising a $C_{12-24}$ fatty acid such as 12-hydroxylstearic acid and typically other compounds useful in converting amorphous calcium carbonate to calcite calcium carbonate, such as alcohols, lower aliphatic carboxylic acids, ketones, etc., to convert the calcium carbonate crystal form; 2) calcium salts of boric acid and $C_{12-24}$ fatty acids are formed; and 3) an isocyanate compound and one or more amine containing compounds are converted into a polyurea. In preferred embodiments, all of the calcium borates and the calcium soap of $C_{12-24}$ aliphatic fatty acids are formed in situ during preparation of the grease starting from an overbased calcium sulfonate starting material.

Typically, the mixture heated during calcite formation also comprises mono- and/or di-alkyl benzene sulfonic acid in which the alkyl groups contain 12 to 40 carbon atoms, and often the mixture of also comprises boric acid.

In some embodiments, additional $C_{12-24}$ fatty acids are added, optionally with boric acid and water, after the calcite has been formed, in which case the resulting mixture is heated to effect conversion of the added materials to calcium salts of boric acid and calcium soaps of $C_{12-24}$ fatty acids.

It is often convenient to introduce all of the boric acid and/or $C_{12-24}$ fatty acids used in the process to the mixture subjected to calcite formation. Where all the boric acid and $C_{12-24}$ fatty acids are present during calcite formation step, there is no need for an additional step to prepare the calcium borate and calcium salts, and the product of 1) and 2) above are formed during a single procedure. Typically, the polyurea is formed after the formation of the products of 1) and 2). Additional components, e.g., additional base oil or additives, may be added and other process steps, e.g., kneading or milling the final grease, may be used.

The overbased calcium sulfonates useful in the preparation of the grease of the invention can be prepared by any technique employed in the art. Typically, these materials can be prepared by heating neutral calcium sulfonate or sulfonic acid, oleaginous medium, i.e., a base oil often comprising a mineral oil, hydrated lime and a carbonation promoter, such as methanol, to the carbonation temperature, and adding sufficient carbon dioxide to produce an overbased sulfonate having the desired TBN as described in U.S. Pat. No. 4,560,489. A molar ratio of 0.55-0.6 $CO_2/Ca(OH)_2$ produces an excellent starting material for the production of the greases of the present invention.

The overbased calcium sulfonate can have a metal ratio of about 6 to 40, e.g., 10 to 36. The base oils are, generally speaking, oils obtained by well-known refining procedures from mineral oils or can be derived from mineral oils. The mineral base oils can be of natural or synthetic character, the proportions of calcium sulfonates in the mineral oil can be variable, e.g., 15 to 45%. A semi-crude, unfiltered mineral oil composition containing about 10 to 20% naphtha and varying proportions of mineral oil and neutral calcium sulfonate is readily usable as a charge stock.

Suitable sulfonic acids useful in the production of the calcium sulfonates are oil-soluble and can be produced by sulfonating a linear or branched chain alkyl benzene, such as a mixture of mono- and di-alkyl benzenes in which the alkyl group contains largely from 12 to 40 carbon atoms, generally mixtures of such alkyl groups. The sulfonic acids are conventionally converted to calcium sulfonates by reaction with calcium hydroxide.

The oleaginous medium content of the finished grease, e.g., non-volatile mineral oil or other non-volatile lubricating oil, includes the total amount of all non-volatile oil present, that is, the oil introduced as part of the original overbased calcium sulfonate composition plus any added non-volatile oil. Any base oil useful in the art may be used and more than one lubricating oil may be used. Examples of useful base oils include naphthenic oil, paraffinic oil, aromatic oil, or a synthetic oil such as a polyalphaolefin (PAO), silicon oils, a fluoronated or polyfluoronated derivative of any of these preceding fluids, or combinations thereof. Refined solvent-extracted hydrogenated dewaxed base oil and combinations of such base oils are often used. The viscosity of the base oil can range from 50 to 10,000 SUS at 100° F., e.g., 200 to 2,000 SUS or 300 to 1500 SUS at 100° F.

The polyurea thickeners of the present invention include diureas and higher oligomeric ureas. Diurea thickeners are preferred. Diurea compounds include those obtained through a reaction of one or more monoamine with a diisocyanate compound or one or more diamine with a mono-isocyanate compound, generally diureas prepared from a diisocyanate are preferred.

Representative examples of diisocyanates include phenylene diisocyanate, diphenyl diisocyanate, tolylenediisocyanate, diphenylmethane diisocyanate, octadecane diisocyanate, decane diisocyanate, and hexane diisocyanate. Representative examples of mono-isocyanates include hexylisocyanate, decylisocyanate, dodecylisocyante, tetradecylisocyanate, hexadecylisocyanate, phenyl isocyanate, cyclohexylisocyanate and xyleneisocyanate.

Representative examples of monoamines include pentylamine, hexylamine, cyclohexylamine, heptylamine, octylamine, decylamine, dodecylamine, tetradecylamine, hexadecylamine, octadecylamine, eicosylamine, dodecenylamine, hexadecenylamine, octadecenylamine, octadecadienylamine, isomers thereof, aniline, substituted anilines, toluidine, naphthylamine, substituted naphthylamines, benzylamine and substituted benzylamines.

Higher oligomeric urea compounds include those obtained through a reaction of a diamine or triamine with a polyisocyante, typically a diisocyanate compound.

Representative examples of diamines include ethylenediamine, propanediamine, butanediamine, hexanediamine, octanediamine, dodecanediamine, octanediamine, hexadecanediamine, cyclohexanediamine, cyclooctanediamine, phenylenediamine, tolylenediamine, xylylenediamine, dianiline methane, and ditoluidinemethane; representative triamines include aminoethyl piperazine, diethylene triamine, dipropylene triamine and N-methyldiethylene triamine.

Examples of preferred urea thickeners include those obtained through a reaction of aliphatic amine such as octylamine, stearylamine, cyclohexyl amine, and often a mixture thereof, with a diisocyanate, such as diphenylmethane diisocyanate.

Calcium-soap-forming fatty acids of 12 to 24 carbon atoms useful in the invention include dodecanoic acid, palmitic acid, stearic acid, oleic acid, ricinoleic acid, 12-hydroxystearic acid. The hydroxy fatty acids, particularly hydroxystearic acid, are preferred since they provide greater thickening to the greases than the unsubstituted fatty acids.

Conversion agents, in addition to the calcium-soap-forming C12-24 fatty acids and boric acid, useful in the formation of calcite include (among many others): water; alcohols, lower aliphatic carboxylic acids, ketones; aldehydes; amines; phosphorus acids; alkyl and aromatic amines; certain imidazoilines; alkanolamines; other boron acids including tetraboric acid; metaboric acid; and esters of such boron acids; and, also, carbon dioxide as such or in combination with water.

Suitable salt-forming acids (complex forming acids) may also be used in preparation of the greases of the present invention, including inorganic acids, such as sulfonic acid, hydrochloric acid, orthophosphoric acids, pyrophosphoric acid, sulfurous acid, boric acid; and organic acids of 1 to 7 carbon atoms, such as formic acid, acetic acid, propionic acid, valeric acid, oxalic acid, malonic acid, succinic acid and benzene sulfonic acid. Boric acid and boric acid formers, however, are preferred since they provide the best grease properties.

In one embodiment of the invention, a polyurea/overbased calcium sulfonate complex grease having a worked cone penetration rating of 295 or less is prepared according to a procedure comprising mixing an overbased calcium sulfonate, a base oil, a $C_{12-24}$ fatty acid such as 12-hydroxylstearic acid, water, detergent dodecylbenzene sulfonic acid, boric acid and a carboxylic acid having from 1 to 7 carbon atoms, such as acetic acid in a sealed high pressure reactor while heating, e.g., at temperatures of above 250° F., e.g., between 270 and 300° F., and elevated pressures, e.g., 20-25 psi; venting the reactor with heating to remove water and volatiles; then adding additional base oil, diisocyanate and one or more amines, heating to effect reaction and removal of volatiles; and then adjusting the final properties of the grease by adding additional base oil and/or additives, followed by any additional processing steps.

For example, a grade 2 grease comprising less than 22 wt % overbased calcium sulfonate can be formed by the following procedure:

To a mixture of 34 parts by weight overbased calcium sulfonate (400TBN) comprising amorphous calcium carbonate and 66 parts non-volatile mineral oil is added 1 to 6 parts, e.g., 2 to 2.5 parts detergent dodecylbenzene sulfonic acid; 0.5 to 5 parts, e.g., 1 to 3.5 parts 12-hydroxy stearic acid; 1 to 7 parts, e.g., 2.5 to 5 parts water; and 0.05 to 3.5 parts, e.g., 0.1 to 3 parts, boric acid. After mixing in a pressure reactor, 0.1 to 1 part, e.g., 0.4 to 0.7 part, acetic acid is added and the resulting mixture is heated to temperatures of 250-270° F. developing a pressure of 20 to 25 psi to convert the amorphous calcium carbonate to calcite. Formation of calcite is monitored by the appearance of calcite peaks in the IR at 880 and 705 $cm^{-1}$. When calcite formation is complete, additional mineral oil is generally added, e.g., in this case from about 35 to 45 parts mineral oil, to the now thickened reaction mixture, after which 8 to 15 parts, e.g., 9 to 12 parts, 4,4-diphenylmethane diisocyanate is added followed by 4 to 8 parts, e.g., 5.5 to 6.4 parts cyclohexanamine and 3.7 to 7, e.g., 4.4 to 5.4 parts, octodecylamine. Heating is performed to about 280° F. to remove water and volatiles, then cooling is performed to below 250° F. If desired, additional components, such as the antioxidant phenyl alpha naphthylamine, are added and the grease is adjusted to the desired grade by addition of additional mineral oil. In order to obtain a smooth homogeneous grease, the product may then be kneaded or milled. "Parts" refers to relative amounts by weight of a component.

Adjusting the levels of the various components in the processes above to obtain a grease with various levels of the overbased calcium sulfonate, calcium borate, calcium fatty acid soaps and polyurea thickener is well within the skill of the average practitioner in the art.

Alternatively, the grease of the present invention may be prepared by a process similar to the above process except that after calcite formation and before addition of the polyurea forming components, additional hydroxy stearic acid and optionally lime are added and mixed at temperatures of about 280° F. Additional boric acid and/or water may also be added during this alternative step. In a less preferred process, the conversion to calcite is run without boric acid and all the boric acid used in the grease is added during this alternative step.

In certain cases, lime or $Ca(OH)_2$ may be added to the reaction mixture at any stage prior to polyurea formation, but in many cases this is not done. Often after carbonation of the starting overbased calcium sulfonate, or after the conversion of amorphous calcium carbonate to calcite, free dispersed lime or calcium hydroxide may be present.

The foregoing percentages are in terms of wt. %, based on the total weight of the grease, reaction mixture or composition being referred to.

As with many commercial calcium sulfonate greases, the greases of the invention are characterized by good extreme pressure and anti-wear properties, high dropping points, good mechanical stability, salt spray and water resistance, thermal stability at high temperature and other desirable properties, even without additives. Significantly, the greases of the present invention have much lower ash content, making them useful in a wider range of applications, than available calcium sulfonate greases, including high speed applications in automobile and other industries, where lower ash content grease products are desired.

The greases of the present invention are well suited for general use as a lubricant between contacting metals and/or elastomeric plastics. They are multi-purpose greases which equal and, in many cases, outperform other high temperature greases such as polyurea greases and are especially effective in environments with high load situations. A limited selection of possible uses includes CV joints, front-wheel drive joints, universal joints and bearings which are subjected to heavy shock loads, fretting, and oscillating motions and high temperatures such as in steel mills. Furthermore, the greases are conveniently prepared from non-toxic and low-cost materials.

EXAMPLES

Example 1

Three hundred eighty grams overbased calcium sulfonate (400TBN) in 720 grams 1100 SUS viscosity oil, 23.5 grams detergent dodecylbenzene sulfonic acid, 21.5 grams 12-hydroxystearic acid, 50 grams water and 2.6 grams boric acid were mixed in a pressure reactor. After addition of 5 grams acetic acid, the reactor was sealed and heated to 250-270° F., developing a pressure of 20 to 25 psi. After 1 hour, thickening and conversion of amorphous carbonate to calcite was complete as determined by infra-red, the reactor was vented and heated to 260° F. Next, after cooling the reaction mixture to 160° F., 430 grams 1100 SUS viscosity oil and 10.88 grams 4,4-diphenylmethane diisocyanate was added, followed by 6.2 grams cyclohexanamine and 5.5 grams octodecylamine. The resulting mixture was heated to form the diurea thickener, water was removed and the reactants were stripped at 280° F. after which the product was cooled to below 250° F., 13 grams phenyl alpha naphthylamine were added and about 230 grams of 500 SUS viscosity oil was added to adjust the product to yield 1850 grams of a grade 2 grease containing 20.5% starting overbased calcium sulfonate and having a penetration rating between 265-295.

Example 2

The procedure of Example 1 was repeated except that the amount of 4,4-diphenylmethane diisocyanate, cyclohexanamine and octodecylamine added was increased 1.2 times respectively and additional oil was added to adjust the final grease thickness, yielding 2035 grams of a grade 2 grease thickness containing 18.67% starting overbased calcium sulfonate.

Comparison Example A

Three hundred eighty grams overbased calcium sulfonate (400TBN) in 720 grams 1100 SUS viscosity oil, 23.5 grams detergent dodecylbenzene sulfonic acid, 21.5 grams 12-hydroxystearic acid, and 50 grams of water were mixed in a pressure reactor. After addition of 5 grams acetic acid, the reactor was sealed and heated to 250-270° F. developing a pressure of 20 to 25 psi. After 1 hour, thickening and conversion of amorphous carbonate to calcite was complete as determined by infra-red and the reactor was vented and cooled to 200° F. with the addition of 200 grams 1100 SUS viscosity oil. To this mixture, 18.4 grams of additional 12-hydroxylstearic acid was added, the resulting mixture was mixed for 15 minutes, after which 29 grams lime in 50 grams water and 23 grams boric acid in 50 grams water were added. The reaction mixture was then mixed at 280° F., the thickness adjusted to grade 2 with about 180 grams 500 SUS viscosity oil, cooled to below 200° F., and 8.3 grams phenyl alpha naphthylamine were added to yield 1670 grams of a grade 2 grease containing 23.6% starting overbased calcium sulfonate.

The greases from the above Example were subjected to the following tests:

Penetration and prolonged penetration (ASTM D217), Dropping Point (ASTMD2265), 4-ball EP (ASTM D2596); 4-Ball Wear (ASTM D2266); Oil separation (ASTMD6184), Water washout performance (ASTM D1264), Copper Corrosion (ASTM 4048), Salt Fog Corrosion (ASTM B117). The results are shown in the following table.

| Properties | Test method | Example 1 | Comparison Example A | Example 2 |
|---|---|---|---|---|
| Appearance | Visual | Smooth | Smooth | Smooth |
| Dropping Point | ASTM D2265 | >316 | >316 | >316 |
| Worked Cone Penetration, 60 Strokes, mm/10 | ASTM D217 | 280 | 284 | 285 |
| Prolonged Penetration Change, 100K Strokes with 20/80 Water, mm/10 | ASTM D217 | −8 | −10 | −13 |
| Prolonged Penetration Change, 100K Strokes, mm/10 | ASTM D217 | 16 | 15 | 18 |
| 4-Ball Wear, mm | ASTM D2266 | 0.38 | 0.42 | 0.45 |
| 4-Ball EP, Weld Point, Kg | ASTM D2596 | 400 | 400 | 315 |
| Water Washout at 79 C., % loss | ASTM D1264 | 1.9 | 3.0 | 2.31 |
| Copper Corrosion, grade | ASTM D4048 | 1b | 1b | 1b |
| Salt Fog Corrosion, 1 mil d.f.t., (dry film thickness) hours | ASTM B117 | >300 | >300 | >300 |

It can be seen from the above data, the polyurea/overbased calcium sulfonate grade 2 greases of Examples 1 and 2 of the present invention have similar performance properties to the grease of Comparative Example A; however, the greases of Examples 1 and 2 of the present invention were prepared in higher yield of grease and had lower concentrations of overbased calcium sulfonate, (and lower ash content) than the grease of Comparative Example A prepared using only an overbased calcium sulfate thickener.

What is claimed is:

1. A high performance, thixotropic polyurea/overbased calcium sulfonate complex hybrid grease comprising:

70 to 85 wt % oleaginous medium in which there is homogeneously dispersed:

at least 8 but less than 20 wt % overbased calcium sulfonate complex thickener comprising fine particles of calcium carbonate in calcite form;

0.5 to 6.5 wt % polyurea thickener;

0.05 to 3 wt % calcium borate or calcium borate complex;

0.5 to 3.5 wt % calcium soap of C12-24 aliphatic fatty acids; and 0 to 3 wt % lime or calcium hydroxide, wherein all percentages are weight % based on the total weight of the grease.

2. The grease as claimed in claim 1 comprising:

75 to 85 wt % oleaginous medium;

10 to 19 wt % overbased calcium sulfonate complex thickener comprising fine particles of calcium carbonate in calcite form;

0.8 to 5 wt % polyurea thickener;

0.1 to 3 wt % calcium borate or a calcium borate complex;

0.8 to 3.5 wt % calcium soap of C12-24 hydroxy aliphatic fatty acids; and 0 to 3 wt % lime or calcium hydroxide.

3. The grease as claimed in claim 1, wherein the calcium soap of a fatty acid of 12 to 24 carbon atoms comprises a calcium soap of a hydroxy fatty acid of 12 to 24 carbon atoms.

4. The grease as claimed in claim 3, wherein the calcium soap of hydroxy fatty acid of 12 to 24 carbon atoms comprises a calcium soap of hydroxystearic acid.

5. The grease as claimed in claim 1, wherein the calcium soap of C12-24 aliphatic fatty acids comprises a calcium soap of C12-24 hydroxy fatty acids.

6. The grease as claimed in claim 5, wherein the calcium soap of C12-24 hydroxy fatty acids comprises a calcium soap of hydroxystearic acid.

7. The grease as claimed in claim 1, wherein the polyurea thickener is obtained by reaction of a diisocyanate and one or more amine containing compounds.

8. The grease as claimed in claim 7, wherein the diisocyanate comprises 4,4'-diphenylmethane diisocyanate.

9. The grease as claimed in claim 8, wherein the one or more amine containing compounds comprises one or more of octylamine, stearylamine or cyclohexyl amine.

10. The grease as claimed in claim 1 further comprising phenyl alpha-naphthyl amine.

11. A process for preparing the polyurea/overbased calcium sulfonate complex grease of claim 1, the process comprising mixing an overbased calcium sulfonate, a base oil, a C12-24 fatty acid, water, detergent dodecylbenzene sulfonic acid, boric acid and a carboxylic acids having from 1 to 7 carbon atoms, in a sealed reactor while heating under elevated pressure; venting the reactor and then heating to remove water and volatiles; then adding additional base oil, diisocyanate and one or more amines, heating to effect reaction to form a polyurea thickener and removal of volatiles; and then adjusting the final properties of the grease by adding additional base oil and/or additives, followed by any additional processing steps.

12. The process as claimed in claim 11, wherein after calcite formation and before addition of the polyurea forming components, additional hydroxy stearic acid and/or boric acid, water, and an appropriate amount of lime are optionally added and mixed at temperatures of about 280° F.

13. The process as claimed in claim 11, wherein the C12-24 fatty acid is 12-hydroxylstearic acid.

* * * * *